US010322590B2

(12) United States Patent
Raemy et al.

(10) Patent No.: US 10,322,590 B2
(45) Date of Patent: Jun. 18, 2019

(54) METHOD AND DEVICE FOR MARKING AMMUNITION FOR IDENTIFICATION OR TRACKING

(71) Applicant: SICPA HOLDING SA, Prilly (CH)

(72) Inventors: Xavier Cedric Raemy, Belmont-sur-Lausanne (CH); Milan Vasic, Geneva (CH)

(73) Assignee: SICPA HOLDING SA, Prilly (CH)

( * ) Notice: Subject to any disclaimer, the term of this patent is extended or adjusted under 35 U.S.C. 154(b) by 231 days.

(21) Appl. No.: 15/023,889

(22) PCT Filed: Sep. 23, 2014

(86) PCT No.: PCT/EP2014/070215
§ 371 (c)(1),
(2) Date: Mar. 22, 2016

(87) PCT Pub. No.: WO2015/040236
PCT Pub. Date: Mar. 26, 2015

(65) Prior Publication Data

US 2016/0257132 A1 Sep. 8, 2016

Related U.S. Application Data

(60) Provisional application No. 61/881,168, filed on Sep. 23, 2013.

(51) Int. Cl.
*F42B 5/02* (2006.01)
*B41J 3/407* (2006.01)
*F42B 35/00* (2006.01)

(52) U.S. Cl.
CPC ..... *B41J 3/407* (2013.01); *F42B 5/025* (2013.01); *F42B 35/00* (2013.01)

(58) Field of Classification Search
CPC ..... B41J 3/407; F42B 5/02; F42B 5/025
(Continued)

(56) References Cited

U.S. PATENT DOCUMENTS 441,822 A * 12/1890 Browning ..... B44B 5/026 101/4
741,915 A * 10/1903 Kirschbaum ..... B44B 5/026 101/4

(Continued)

FOREIGN PATENT DOCUMENTS

DE 4137819 5/1993
DE 20008517 10/2003

(Continued)

OTHER PUBLICATIONS

Russian office action and Search Report in counterpart Russian Application No. 2016112337 dated Jul. 10, 2017 (and English language translation of Relevant Excerpt).

*Primary Examiner* — Justin Seo
*Assistant Examiner* — Tania C Courson
(74) *Attorney, Agent, or Firm* — Muncy, Geissler, Olds & Lowe, P.C.

(57) ABSTRACT

A method of providing a mark to a case of a cartridge of ammunition. The mark includes at least one sub-mark and is suitable for identification and/or for tracking of the cartridge. At least one indenter selectively radially indents a circumferential surface of a bottom of the case, thereby forming the at least one sub-mark.

13 Claims, 1 Drawing Sheet

(58) Field of Classification Search
USPC ..... 33/18.1, 27.12, 41.5, 528; 42/1.01, 106; 86/1.1; 347/110; 102/430, 501
See application file for complete search history.

(56) References Cited

U.S. PATENT DOCUMENTS 1,329,941 A * 2/1920 Warme ..... B44B 5/0009 101/6
1,537,685 A * 5/1925 Ladd ..... B44B 5/026 101/4
1,632,156 A 6/1927 Wiley
1,641,562 A * 9/1927 Will ..... B44B 5/026 101/4
1,650,908 A * 11/1927 Ramsey ..... F42B 12/36 102/430
1,887,324 A * 11/1932 Pocoroba ..... G09F 3/00 102/501
2,035,149 A * 3/1936 Dolan ..... A63B 45/02 101/4
2,316,517 A * 4/1943 Huntley ..... B41F 17/18 101/18
2,417,865 A * 3/1947 Douglass ..... A63B 45/02 101/335
3,227,071 A * 1/1966 Szczepanski ..... B44B 5/022 101/4
3,929,066 A * 12/1975 Pillon ..... B44B 5/0014 101/40.1
4,150,624 A * 4/1979 Hammond ..... F42B 5/025 102/293
4,179,988 A * 12/1979 Rath ..... B41F 17/30 101/109
4,269,090 A * 5/1981 Ingber ..... B41F 17/16 101/35
4,275,652 A * 6/1981 Bo ..... B44B 5/0028 101/38.1
4,335,295 A * 6/1982 Fowler ..... B23B 31/202 101/3.1
4,599,942 A * 7/1986 Bo ..... B44B 5/026 101/4
5,200,573 A * 4/1993 Blood ..... F42B 7/046 102/501
5,456,012 A * 10/1995 Therond ..... B23Q 1/545 101/4
5,511,483 A * 4/1996 Griffin, Jr. ..... F42B 5/025 102/501
5,685,100 A * 11/1997 Atchison ..... F41C 27/00 102/430
5,698,816 A * 12/1997 Roxby ..... F42B 5/025 102/439
5,758,446 A * 6/1998 Atchison ..... F41A 21/18 102/430
6,209,459 B1 * 4/2001 Kaufman ..... F42B 5/025 102/439
6,293,204 B1 * 9/2001 Regen ..... F42B 5/025 102/430
6,327,791 B1 * 12/2001 Norcross ..... F15B 15/2846 33/706
6,810,816 B2 * 11/2004 Rennard ..... F42B 5/025 102/430
7,047,877 B2 * 5/2006 Powney ..... A63B 45/02 101/35
7,240,619 B2 * 7/2007 Kinoshita ..... F42B 30/02 102/430
7,448,121 B1 * 11/2008 Hung ..... C25D 5/022 204/194
7,823,495 B2 11/2010 Martino Filho
8,960,055 B2 * 2/2015 Lin ..... B25B 13/06 81/119
9,052,176 B1 * 6/2015 Stefano ..... F42B 33/14
9,103,639 B2 * 8/2015 Barthelemy ..... F42B 8/00
9,109,866 B2 * 8/2015 Newman ..... F42B 33/10
9,157,709 B2 * 10/2015 Nuetzman ..... F42B 5/28
2003/0014895 A1 * 1/2003 Lizotte ..... B23K 26/04 42/1.01
2003/0217665 A1 * 11/2003 Rennard ..... F42B 5/025 102/430
2005/0005806 A1 1/2005 Mace et al.
2005/0045056 A1 * 3/2005 EkenediliChukwu .... F42B 5/02 102/430
2005/0241203 A1 * 11/2005 Lizotte ..... F41A 21/12 42/1.01
2006/0027132 A1 * 2/2006 Libra ..... F42B 12/06 102/522
2007/0084316 A1 * 4/2007 Trice ..... B23B 27/06 82/1.11
2008/0184873 A1 8/2008 Martino Filho
2009/0094844 A1 * 4/2009 Shenderovich ..... B28D 1/225 33/18.1
2016/0201220 A1 * 7/2016 Li ..... C30B 33/00 428/81
2016/0216087 A1 * 7/2016 Raemy ..... F42B 5/025
2016/0259976 A1 * 9/2016 Halasz ..... B23H 9/06

FOREIGN PATENT DOCUMENTS

RU 2213932 10/2003
WO WO 2006/039766 4/2006

* cited by examiner

METHOD AND DEVICE FOR MARKING AMMUNITION FOR IDENTIFICATION OR TRACKING

CROSS-REFERENCE TO RELATED APPLICATIONS

The present application is a National Stage Application of International Application No. PCT/EP2014/070215 filed Sep. 23, 2014, which published as WO 2015/040236 A1 on Mar. 26, 2015, the disclosures of which are expressly incorporated by reference herein in their entireties. Further, the present application claims the benefit of U.S. provisional application No. 61/881,168, filed Sep. 23, 2013, the disclosure of which is expressly incorporated by reference herein in its entirety.

BACKGROUND OF THE DISCLOSURE

1. Field of the Disclosure

The present disclosure relates to the field of marking of ammunition. In particular, the disclosure relates to a method of providing a mark to a case of a cartridge of ammunition, wherein the mark comprises at least one sub-mark and is suitable for identification or for tracking of the cartridge. Further, the disclosure relates to a device for providing such a mark to a cartridge of ammunition.

2. Background Description

Ammunition marking is an important tool for tracking of ammunition as well as for controlling the use of it. Further, it can be used for quality assurance and for ensuring proper use of ammunition by clearly identifying the sort of ammunition, in particular its type and caliber. In connection with the use of ammunition by military and law enforcement forces, marking of ammunition is important for stock pile management, transportation and record keeping. Particularly in the civil sector, marking ammunition potentially helps investigating crimes in which firearms are involved.

It is common that marks in the form of a stamp are applied to the bottom of a cartridge, also called round, of ammunition. However, due to the limited space available on the bottom of a cartridge, the amount of information which can be applied to the cartridge via such a marking is also very limited. There are techniques of applying a mark also to the lateral outer surface of a cartridge case. Marking the lateral outer surface of a cartridge case is, today, achieved by use of printing techniques. The usual technique of stamping, as it is applied to the bottom of the case of the cartridge, is much less suitable for application to the case in its lateral or radial direction. Thus, press stamping is not used for marking the lateral surface of the case.

It is known from U.S. Pat. No. 7,823,495 B2 to use laser engraving techniques for engraving the surface of a cartridge, in particular an extractor groove which is typically placed in the area near the bottom of the case. A particular drawback of this method is that the equipment needed for laser engraving is very complex and, thus, expensive, which is a decisive disadvantage for any manufacturer who wants to use the laser engraving method for marking cartridges of ammunition.

Other known techniques, namely press stamping and silk screen or similar printing techniques, have other disadvantages. As to the press stamping, in addition to the fact that this method cannot be applied to the lateral surface of a case of a cartridge, the costs for producing press stamping dies are also significant, similar to the laser engraving equipment. As to the printing techniques, the marks provided by these techniques tend to lose their readability after the cartridge has been fired and can easily be counterfeited.

Accordingly, there is a need for a less expensive method for marking ammunition that is capable of applying marks also to the lateral surface of an ammunition cartridge case so as to increase the maximum amount of information provided by the mark.

SUMMARY OF THE DISCLOSURE

It is an aim of the present disclosure to provide a method and a device which allow for efficiently marking ammunition by a durable and reliable mark that cannot easily be removed.

This problem is solved by the method and the device according to respective independent claims. Further preferred features of the method or device are recited in the dependent claims and detailed in the following description.

Throughout this text, the cartridge of ammunition is also referred to as a round of ammunition. The inventive method of providing a mark to a case of a cartridge of ammunition, or to a round of ammunition, the mark comprising at least one sub-mark and being suitable for identification or for tracking of the cartridge, makes use of at least one indenter, which selectively radially indents a circumferential surface of a bottom of the case, thereby forming the at least one sub-mark. The indenter is preferably present in the form of a finger, but the form of the embodiment for the indenter can be chosen depending on the space available next to the cartridge or round of ammunition.

A cartridge or round of ammunition usually comprises a case, a primer, a propellant and, optionally, one or more projectiles. The propellant usually is a chemical composition to be ignited by the primer, which then explodes and generates high pressure that can be used to propel a projectile.

Common names for propellants are "powder", "gunpowder", "smoke-less powder" and "black powder". In order to ignite the propellant, the cartridge usually comprises the primer, which, upon impact of a firing pin, ignites the propellant. The primer can be provided with a separate casing enclosing a priming mixture. Further, at least the propellant, usually also the primer and, optionally, also a projectile are at least partially enclosed in a case, at least part of which forms at least part of an outer surface of the cartridge or round. If a projectile is provided, the projectile usually is at least partially enclosed in the case on the side of the propellant opposite to the primer. Projectiles are, however, not essential or required.

The case usually is cylindrical, conical, or bottle-shaped and has an axis of symmetry defining longitudinal, radial, and circumferential directions. In the longitudinal direction, which is parallel to the axis of symmetry, the propellant usually is located between a primer and a projectile or several projectiles. Radially, i.e. perpendicular to the axis of symmetry, the case usually forms the outer surface of the cartridge.

Most cartridges further have an extraction groove in the case. This is usually applied to the case in the vicinity of a bottom of the case. In the present application, the sub-marks can be applied both to the bottom of the case and to the extraction groove. In other words, the extraction groove is, in this context, to be considered to be part of the bottom of the case.

The mark to be applied to the case is meant to identify a cartridge. The mark can be used, for example, to individually identify a specific piece of ammunition or to more generally identify its type, such as its caliber. For example, the mark, which is possibly encoded, may be a lot number or a serial number of the cartridge. Hence, the mark in the present context is not merely an accidental or random mark on the surface of a case but an intentionally applied mark that can have the form of indentations that are sized and/or separated from each other in a recognizable manner so as to form a barcode or similar code.

At least one indenter is used to selectively radially indent a circumferential surface of a bottom of the case to thereby form the at least one sub-mark. Indenting the surface should be understood as the indenter being pressed into the surface of the case in the vicinity of its bottom, thereby deforming the case, in order to form a groove into the case. Pressing the indenter into the surface leads to locally stressing the surface of the case beyond its elastic limit so that an inelastic deformation is achieved.

The bottom of the case in the sense of the present disclosure is defined to comprise the portion of the case that extends from an extraction groove towards the end of the case opposite to any projectile. Preferably, the bottom of the case additionally includes the extraction groove.

In contrast to the prior art according to U.S. Pat. No. 7,823,495 B2, it is not necessary for the present disclosure to use expensive laser equipment for engraving a surface of the case of the cartridge.

Accordingly, the inventive method allows the application of marks to the circumferential surface of the bottom of the case of the cartridge of ammunition in an inexpensive way. The marks thus applied are not more easily removable or less durable than marks resulting from press stamping, laser engraving or printing.

Preferably, the mark comprises a plurality of sub-marks. By using a plurality of sub-marks it is possible to encode relatively complex information on the surface of the case. An example for a mark having a plurality of sub-marks is a barcode consisting of several indentations of different widths along the circumferential direction of the case.

In a preferred embodiment, the sub-mark is at least one of a material displacement, a deformation, a scratch, and a hole. The sub-mark preferably has a radial minimum depth for effectively protecting the sub-mark against wear or intentional removal of the sub-mark by an unauthorized person. A preferred minimum depth of the sub-mark is about 10% of the thickness of the case. Here, the thickness of the case should be understood as the thickness of the material, typically a metal, which radially and circumferentially encloses, e. g., the propellant.

Preferably, the mark provides information on the basis of at least one of an absolute position of the at least one sub-mark on the case, a relative position of the at least one sub-mark with respect to at least one further sub-mark, the existence or non-existence of the at least one sub-mark at a predetermined position, a depth of the at least one sub-mark on the case, a width of the at least one sub-mark, and a modulation in depth or width of the at least one sub-mark.

All of the above-mentioned features of the sub-mark can be used for encoding or decoding of information applied to the case via the sub-marks. The absolute position of the sub-mark should be understood as the position of the sub-mark in relation to the case, as opposed to a relative position of the sub-mark in relation to other sub-marks on the case. The depth and width of the sub-mark can be detected by a respective detector, as can the modulation in depth or width of the at least one sub-mark.

In a preferred embodiment, the at least one indenter comprises a material that is harder than a material of the case. It is preferred that the indenter is harder than the material of the case to ensure that the sub-marks are reliably indented in the surface of the case. A possible material for the indenter would, therefore, be diamond, diamond-like carbon, or similar materials. Alternatively, it is possible that the indenter is made of a metal or an alloy that preferably is harder than the material of the case.

In a preferred embodiment, the at least one indenter is moved by an actuator from an idle position to an active position for radially indenting into the circumferential surface of the bottom of the case. Using such an actuator allows for very precisely marking the case.

Further preferably, the active position of the indenter is variable and the depth of the at least one sub-mark on the case may be modulated by varying the active position of the indenter. Varying the depth of the sub-mark increases the degrees of freedom for encrypting information via the mark on the case.

The variable active position of the indenter can be understood to indicate a plurality of active positions or a continuously variable active position that can be controlled by the actuator. In any case, the amount and density of information that can be applied to the cartridge can be significantly increased.

In a preferred embodiment, a plurality of indenters selectively radially indent a circumferential surface of the bottom of the case. If the plurality of indenters is used, the method for marking the case can be made substantially more efficiently because several marks can simultaneously be applied to the case.

Further preferably, a computer system controls the at least one indenter, preferably the plurality indenters, and a position of the cartridge in order to generate a predetermined mark on the cartridge in accordance with the above mentioned methods.

A device according to the present disclosure for providing a mark to a case of a cartridge of ammunition, the mark comprising at least one sub-mark and being suitable for identification or for tracking of the cartridge, comprises at least one indenter. The indenter is configured for selectively radially indenting a circumferential surface of a bottom of the case for thereby forming the at least one sub-mark, the device preferably being configured for carrying out at least one of the above-outlined methods.

It is preferred that the device comprises an actuator which is configured for moving the at least one indenter between an idle position, in which the indenter does not interact with the case, and an active position, in which the indenter interacts with the case such that the at least one sub-mark is formed. The active position of the indenter is a position in which the indenter radially indents into the circumferential surface of the bottom of the case in order to form the sub-mark.

In a preferred embodiment, the active position of the indenter is variable. This can be understood as a plurality of active positions, which indicates a plurality of positions to which the indenter can be moved by the actuator and, in these positions, interacts with the case such that a sub-mark can be formed. Alternatively, the active position of the indenter being variable can also be understood as a continuous variation of the active position to indent a plurality of different depths of the sub-mark into the case.

In a preferred embodiment, the device comprises a plurality of indenters that are configured for selectively radially indenting a circumferential surface of the bottom of the case for thereby forming a plurality of sub-marks. The use of a plurality of indenters makes the device more efficient and allows marking of a case in less time because the plurality of sub-marks can be applied to the case simultaneously.

In a further preferred embodiment, the device comprises a computer system that is configured for controlling the at least one indenter, preferably a plurality of indenters, and for positioning the cartridge in order to allow for generating a predetermined mark on the cartridge.

The present method and device and their preferred embodiments as outlined above allow for solving the above-identified problem. In particular, marking a case of a cartridge of ammunition is made possible in a very efficient manner, it being possible to apply the mark to the lateral surface of the case with a high density of information. The mark cannot easily be removed from the cartridge and is resistant to wear.

DETAILED DESCRIPTION OF EMBODIMENTS OF THE DISCLOSURE

Figure 1:
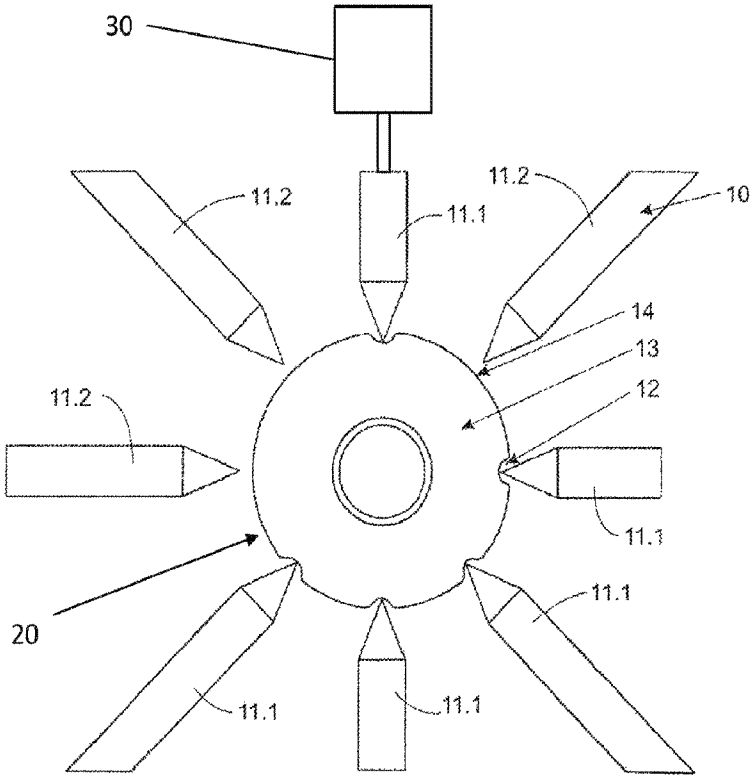
FIG. 1 is a bottom view of a case of a cartridge of ammunition that illustrates a preferred method in accordance with aspects of the disclosure.

FIG. 1 illustrates a preferred method for providing a mark to a case 13 of a cartridge of ammunition. The mark comprises a plurality of sub-marks 12 which are applied to the case 13 by, in the illustrated embodiment, a plurality of indenters, e.g., compression fingers 10, which are structured and arranged to selectively radially indent a circumferential surface of a bottom 20 of the case 13.

The bottom view of the case 13 of FIG. 1 shows the bottom surface of the case 13 by which the firing pin of a gun activates the primer in the case 13 to ignite the propellant and, optionally, fire the projectile. The bottom of the case 13 is located at the end of the cartridge opposite to any projectile. This bottom surface of the case 13 can, in addition to the marks of present disclosure, be marked by a head stamp in the usual manner, as known from the prior art. Such a head stamp is, however, not illustrated in FIG. 1.

FIG. 1 illustrates that a circumference of the bottom 20 forms a circle, if no indentation is applied. At certain positions along the circumference, compression fingers 10 are illustrated as indenting the circumferential surface of the bottom 20, which surface cannot be seen in FIG. 1, to thereby form sub-marks 12. In FIG. 1, eight equally circumferentially distanced compression fingers 10 are illustrated. However, the method can be carried out by use of a single compression finger 10 or almost any higher number of compression fingers 10 with regular or irregular, fixed or variable circumferential distances to each other.

As can be seen in FIG. 1, at selected positions along the circumference, sub-marks are applied or not-applied by the compression fingers 10. In the example of FIG. 1, eight predetermined positions exist for forming a sub-mark or not, namely, the angular positions of the compression fingers 10. Whether or not a sub-mark exists at these respective predetermined positions is used to encode information to the case 13 via the mark for identification and/or tracking of the cartridge. At the angular position 14 on the circumferential surface of the bottom 20, a compression finger 10 is present and could indent the surface for forming a sub-mark. However, in the situation illustrated in FIG. 1, no sub-mark 12 is formed at this position 14 so that the non-existence of a sub-mark at this position can be detected by a respective detector.

By using predetermined positions for the sub-marks, it is possible to encode information, e.g. on the basis of the binary system, also on the basis of non-existing indentations at one or more of these positions.

However, in addition to simply detecting whether or not a sub-mark is present at a certain predetermined position on the surface of the case 13, it is also possible to vary the shape of the sub-mark 12, in particular the depth of the indentation, to thereby add further degrees of freedom in order to increase the information density of the mark.

FIG. 1 illustrates, of the compression fingers 10, a plurality of (e.g., four) active compression fingers 11.1, as well as a plurality of (e.g., three) idle compression fingers 11.2. While the active compression fingers 11.1 are illustrated to indent and form a respective sub-mark 12, the idle compression fingers 11.2 are not in contact with the case 13.

A preferred device for carrying out the method illustrated in FIG. 1 comprises a plurality of compression fingers 10, which, by use of actuators 30 (only one of which is schematically depicted in FIG. 1), can be moved between an idle position and at least one active position. In order to increase the number of degrees of freedom and, thereby, the information density of the mark, it is further preferred that the actuators are configured for moving the compression fingers 10 between an idle position and a variable active position. The variable active position can be a plurality of stepwise differing active positions or a continuously varying active position.

Preferably, the actuators of the compression fingers 10, in particular if there is more than one compression finger 10 involved, are controlled by a computer system that is configured to coordinate the compression fingers and the position and orientation of the cartridge and its case 13. Thereby, a preferred method can be realized in a very efficient way, wherein a plurality of sub-marks 12 can be applied to the case 13 simultaneously.

Figure 2:
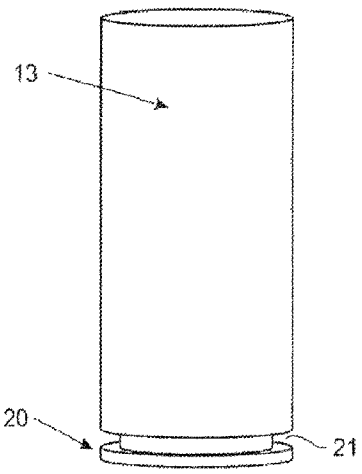
FIG. 2 PRIOR ART
FIG. 2 is a side view of the case of the cartridge of FIG. 1, illustrating a portion of the case in accordance with aspects of the disclosure.

FIG. 2 is a side view of the case 13 and illustrates the bottom 20 of the case 13 as a portion of the case 13 and an extractor groove 21.

This portion of the case 13 usually contains parts of the primer. However, in the context of the present disclosure, this portion of the cartridge, i.e. the bottom 20 and, preferably, also the extractor groove 21, is considered to be the bottom 20 of the case 13.

The invention claimed is:

1. Method of providing a mark to a case of a cartridge of ammunition, the mark comprising at least one sub-mark and the mark being suitable for identification or for tracking of the cartridge, the method comprising:

selectively radially indenting a circumferential surface of a bottom of the case using an indenter in the form of a compression finger, thereby forming the at least one sub-mark, wherein indenting the circumferential surface comprises locally stressing the circumferential surface of the case beyond its elastic limit so that an inelastic deformation is achieved, wherein the at least one indenter is moveable by an actuator from an idle position to an active position for forming the at least one sub-mark in the bottom of the case.

2. Method of claim 1, wherein the mark comprises a plurality of sub-marks.

3. Method of claim 1, wherein the sub-mark comprises at least one of a material displacement, a deformation, and a hole.

4. Method of claim 1, wherein the mark provides information on the basis of at least one of:

an absolute position of the at least one sub-mark on the case, a relative position of the at least one sub-mark with respect to at least one further sub-mark, the existence or non-existence of the at least one sub-mark at a predetermined position, a depth of the at least one sub-mark on the case, a width of the at least one sub-mark, and a modulation in depth and/or width of the at least one sub-mark.

5. Method of claim 1, wherein the case comprises a case material, and the at least one indenter comprises a material that is harder than the case material.

6. Method of claim 1, wherein the active position of the indenter is variable and a depth of the at least one sub-mark on the case is modulated by varying the active position of the indenter.

7. Method of claim 1, wherein a plurality of indenters selectively radially indent a circumferential surface of the bottom.

8. Method of claim 1, further comprising a computer system controlling the at least one indenter and a position of the cartridge in order to generate the mark as a predetermined mark on the cartridge.

9. Device of claim 1, wherein the active position of indenter is variable.

10. Device for providing a mark to a case of a cartridge of ammunition, the mark comprising at least one sub-mark and being suitable for identification or for tracking of the cartridge, the device comprising:

at least one indenter in the form of the compression finger configured for selectively radially indenting a circumferential surface of the bottom of the case, thereby forming the at least one sub-mark, wherein the device is configured for carrying out the method of claim 1.

11. Device for providing a mark to a case of a cartridge of ammunition, the mark comprising at least one sub-mark and being suitable for identification or for tracking of the cartridge, the device comprising:

at least one indenter in the form of a compression finger configured for selectively radially indenting a circumferential surface of a bottom of the case, for thereby forming the at least one sub-mark, an actuator configured for moving the at least one indenter between an idle position, in which the indenter does not interact with the case, and an active position, in which the indenter interacts with the case to form the at least one sub-mark, wherein indenting the circumferential surface comprises locally stressing the circumferential surface of the case beyond its elastic limit so that an inelastic deformation is achieved.

12. Device of claim 11, wherein the at least one indenter comprises a plurality of indenters configured for selectively radially indenting a circumferential surface of the bottom of the case for thereby forming a plurality of the sub-marks.

13. Device of claim 11, further comprising a computer system configured for controlling the at least one indenter and configured for positioning the cartridge for generating a predetermined mark on the cartridge.

* * * * *